United States Patent [19]

Birdsall

[11] 4,386,122

[45] May 31, 1983

[54] METHOD AND APPARATUS FOR GALVANIZING ARTICLES

[76] Inventor: J. Calvin Birdsall, P.O. Box 218789, Houston, Tex. 77218

[21] Appl. No.: 301,876

[22] Filed: Sep. 14, 1981

[51] Int. Cl.[3] ..... B05D 3/12

[52] U.S. Cl. ..... 427/241; 118/54; 118/57; 118/500; 427/346; 427/347; 494/84; 210/781; 210/360.1

[58] Field of Search ..... 118/54, 57, 500; 427/241, 346, 347; 233/1 A

[56] References Cited

U.S. PATENT DOCUMENTS

| | | | |
|---|---|---|---|
| 1,489,393 | 4/1924 | Milne | 118/57 |
| 3,699,918 | 10/1972 | Garrison | 118/54 |
| 4,103,643 | 8/1978 | Staunton | 118/52 X |
| 4,170,191 | 10/1979 | Juve | 118/52 |

FOREIGN PATENT DOCUMENTS

| | | | |
|---|---|---|---|
| 2328688 | 1/1975 | Fed. Rep. of Germany | 427/241 |
| 2220592 | 10/1974 | France | 118/54 |

*Primary Examiner*—Shrive P. Beck

*Attorney, Agent, or Firm*—Bard, Groves, Sroufe & Bishop

[57] ABSTRACT

An improved galvanizing system is provided having a centrifuge assembly wherein an elongate member positively couples a motor means to a container holding articles to be spun. This positive engagement results in more rapid rotational acceleration and deceleration. A dumping means is provided to automatically remove articles from the container. Further, an automated ejection means is provided for removing the empty container from the centrifuge assembly.

12 Claims, 5 Drawing Figures

METHOD AND APPARATUS FOR GALVANIZING ARTICLES

BACKGROUND OF THE INVENTION

This invention relates to a method and apparatus for removing excess zinc from an article coated with molten zinc. In particular, it relates to a method and apparatus for spinning articles dipped in molten zinc to remove the excess zinc.

In conventional galvanizing methods, the metal article to be coated undergoes five distinct treatments. Initially, the metal article is passed through a caustic bath where oils and greases are eliminated and the metal is thoroughly washed clean. A typical caustic used in this first stage bath is sodium hydroxide.

From the first stage caustic bath, the cleaned metal article is passed into a second stage water-rinse bath where caustic from the first bath is removed. The third stage bath in the process contains an acid such as hydrochloric acid. This third stage bath is termed the "pickling" bath. It is in this third stage bath that the surface preparation of the metal article to be galvaninzed occurs. Thus, the pickling bath removes iron oxide from the metal object to be galvanized.

From the pickling bath, the metal article passes to a fourth stage bath, termed the "preflux" bath, which conventionally contains a solution of ammonium chloride and zinc chloride. It is in this preflux bath that the metal article undergoes secondary surface preparation, wherein wetting agents, such as ammonium chloride and zinc ammonium chloride, are added to the surface of the metal object.

The fifth and final treatment bath in the galvanizing process is a tank commonly containing a molten metal such as zinc. The article is submerged in molten metal to apply a coating to the article prepared as previously described in the initial four treatment stages.

Conventional methods of galvanizing articles usually include a spinning step to throw off excess molten metal or "spelter". After the coating step previously described, the articles are removed and usually placed in a floor mounted centrifuge and spun to remove the spelter. This spelter strikes the sides of the centrifuge and is collected for subsequent removal and reuse. The articles are then removed from the centrifuge while they are still hot and submerged in a quench tank. The thusly coated articles are then removed from the quench tank for sorting and packaging.

There are many drawbacks to the above-described conventional galvanizing process, but it has been in use for many years with only minor modifications. A major drawback of the conventional floor mounted centrifuge process has been that the articles cannot be accelerated quickly to rotational speed due to the relatively low torque of the conventional electric or air motors employed in conventional floor mounted centrifuges. Further, even if the centrifuge was capable of greater torque and therefore faster rotational acceleration, the great inertia of the basket and articles imparts such high resistance to acceleration that the floor of the centrifuge slips relative to the basket containing the articles coated with the zinc so that rapid acceleration or deceleration cannot be achieved. To minimize this problem, the weight capacity of the centrifuge is kept low, conventionally about 100 to 200 pounds.

An alternative apparatus for spinning articles in a galvanizing process is the suspended centrifuge. An example of the suspended centrifuge technique is described in U.S. Pat. No. 3,699,918 to Garrison. In this technique, a perforate basket containing the work to be galvanized is suspended from a air motor which, in turn, is suspended from a hoist. This motor and hoist assembly travels along an overhead track which permits the basket suspended from the assembly to be dipped in each of the pretreatment baths, as desired. After pretreating, the basket is placed in the zinc kettle to be cooked in the conventional manner. Thereafter, the hoist and motor assembly lifts the basket from the zinc bath and spins the basket over the zinc bath permitting the spelter to fall back into the kettle. After spinning, the hoist and motor assembly places the basket in the quench tank or places the basket in an unloading station wherein the contents of the perforate basket is dumped into the quench tank.

Although the suspended centrifuge techniques provide larger load capacities and the parts are spun more quickly after removal of the basket from the kettle than with the conventional floor mounted centrifuge, it too has several disadvantages. In the suspended centrifuge method, the basket is coupled to the hoist and motor assembly by a hook through an eye on the basket. By necessity, the hook must be small enough to be quickly and easily passed into the basket eye, however the hook must be strong enough to withstand repeated transmission of rotational torque to the basket. These competing interests have resulted in a hook which is prone to breaking under stress.

It is apparent that breaking stress is most likely to occur while the basket is spinning over a tank of molten metal. If the hook breaks, a basket weighing several hundred pounds and spinning approximately 500 rpm is dropped from a height into a kettle of molten metal exposing the workers nearby to serious injury.

A second serious drawback is the limitation of acceleration torque which can be applied to the basket due to the inertia of the basket in relation to the mass of the free swinging motor and hoist assembly. When the basket is suspended and the motor is accuated, the tendency is for the motor and hoist assembly to turn and the basket to remain motionless. To overcome this tendency, a long metal handle is attached to the motor and hoist assembly to be held by an operator. Although the length of the handle permits a mechanical advantage, the acceleration and deceleration is limited by the strength of the operator. Further, given that the motor is started and stopped about every seven minutes, fatigue by the operator may result in the handle being pulled from the hand of the operator to strike another worker or to strike the operator upon completion of a revolution.

These and other disadvantages of the prior art are overcome by the present invention, however, and improved methods and apparatus are provided for removing excess molten metal from articles in the galvanizing process.

SUMMARY OF THE INVENTION

In a particularly suitable embodiment of the present invention, a method and apparatus is provided for removing excess metal in a galvanizing process. In particular, the present invention relates to a method and apparatus for positively engaging the bottom of a barrier means such as a metal basket containing galvanizing work and rapidly rotationally accelerating and decelerating the barrier means to remove excess molten metal.

One embodiment of the present invention utilizes a turntable having disposed thereon a spindle which positively engages a perforate basket containing galvanizing work. A shield means is placed over the turntable spindle and basket assembly and the turntable, spindle and basket are rapidly rotated. The excess molten metal is thrown out of the perforate basket and against the inner surface of the shield means. Thereafter, the perforate basket, spindle and turntable are rapidly decelerated to separate any galvanizing work stuck together.

In another embodiment of the present invention the shield means contains a flange means which disengages the basket from the spindle and turntable when the shield means is lifted. Thereafter, the shield means carrying the basket is tilted to dump the perforate basket containing the work into an inclined pathway, such as a chute. The basket slides down the pathway and is abruptly halted by two stop members. This abrupt halt dislodges the contents of the basket into a quench tank and leaves the now empty basket resting on the pathway.

In yet another embodiment of the present invention, the pathway is pivotally attached to a support means such that the support means may be tilted after the basket has been emptied to eject the basket into a receiving conveyor system.

It is a feature of the present invention to provide a centrifuge which is capable of removing more molten metal from articles in a galvanizing process.

It is another feature of the present invention to provide a centrifuge which is capable of sufficiently rapid deceleration to produce separated articles which do not need to be manually broken apart.

It is yet another feature of the present invention to provide a centrifuge which is capable of adequately spinning large quantities of articles in a galvanizing process.

It is another feature of the present invention to provide a centrifuge which is capable of rapid, repeated cycling without undue wear on the apparatus.

It is yet another feature of the present invention to provide a centrifuge which produces separated, discrete articles which are amenable to automated handling.

It is still another feature of the present invention to provide a floor mounted galvanizing centrifuge which may be positively engaged with a basket containing articles which have been dipped in molten metal and thereafter impart rapid rotational acceleration and deceleration.

It is a further feature of the present invention to provide a removable shield surrounding a floor mounted centrifuge.

It is yet another feature of the present invention to provide a means for positively disengaging a centrifuge basket from a spinning mechanism.

It is yet another feature of the present invention to provide a galvanizing centrifuge capable of accelerating and decelerating large quantities of articles in a galvanizing process.

It is a further feature of the present invention to provide a galvanizing centrifuge wherein the coupling between the spinning mechanism and the centrifuge basket is separate and apart from the basket lifting means.

It is another feature of the present invention to provide a galvanizing centrifuge wherein the spinning torque of the basket is counteracted by a firmly planted floor mounted base.

It is a further feature of the present invention to provide a galvanizing centrifuge wherein the basket containing articles from the galvanizing process is disengaged from the spinning mechanism and automatically removed from the basket without manual assistance.

It is still a further feature of the present invention to provide a galvanizing centrifuge wherein a basket which has been emptied of parts may be automatically ejected from the centrifuge mechanism without manual assist.

It is yet another feature of the present invention to provide an apparatus for removing excess molten metal from a group of articles, comprising a perforate container capable of confining articles coated with molten metal, a support means capable of supporting said perforate container, said support means being spinnably mounted on a substantially non-rotatable base, a coupling means releasably connecting said support means and said perforate contrainer to positively, non-frictionally couple said perforate container to said support means, a power means interconnected to said support means to selectively impart rotational acceleration or deceleration to said support means, and a removable shielding means surrounding said support means and adapted to block and collect molten metal thrown from said articles.

These and other features and advantages of this invention will become apparent from the following detailed description, wherein reference is made to the figures in the accompanying drawings.

IN THE DRAWINGS

DETAILED DESCRIPTION

Figures 1, 5:
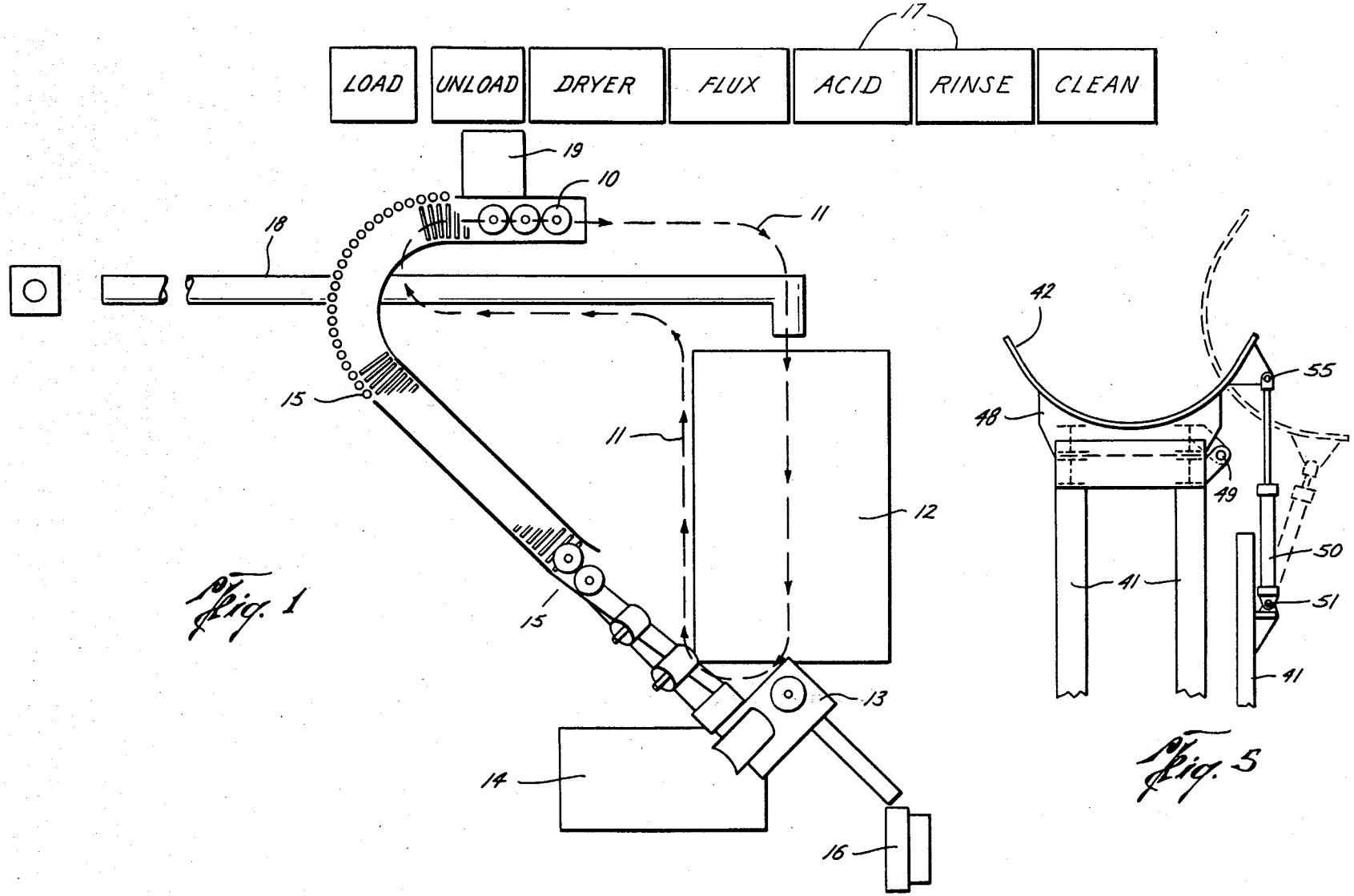
FIG. 1 is a representation of a galvanizing system particularly suited for utilizing the present invention.
FIG. 5 is a end view of an alternative embodiment of the present invention showing a means for removing a spin basket after the articles to be galvanized have been removed.

Referring now to FIG. 1, there may be seen a pictorial representation of a system for galvanizing articles wherein an embodiment of the present invention may be seen as it operates within a typical galvanizing process.

Articles to be galvanized are conventionally, passed through a series of pre-treatment steps such as cleaning, rinsing, removal of surface oxides with acid, and exposure to pre-treatment flux. After the articles are passed through pre-treatment baths 17, they are dried and placed in an area convenient for introduction into the metal coating process.

Within loading area 19 the pretreated articles are placed in perforate containers 10. These containers, referred to hereinafter as "baskets", are taken by a convenient means, typically a hoist, not shown, along hoist path 11. Thereafter, the basket 10 is placed into a vat of a molten metal, such as zinc 12, hereinafter referred to as a "kettle". Basket 10 containing the articles thereafter "cooks" in kettle 12 until the operator is assured that the articles have been adequately coated with molten metal and that the temperature of the articles has been raised to equal that of the temperature of the molten metal. This time period may vary depending upon the nature and number of the articles, but by way of example, a basket of nails weighing approximately 1,000 pounds requires approximately 5 to 8 minutes in the kettle.

After basket 10 has cooked an appropriate period of time, a hoist removes basket 10 from the kettle 12 and places the basket in the centrifuge assembly 13, which rapidly rotates basket 10 to remove excess molten metal to ensure that the metal coating is sufficiently thin on the article and waste is minimized. The articles are removed from basket 10 and dumped into quench tank 14 filled with water. The now empty basket is ejected from centrifuge assembly 13, as hereinafter described in greater detail and placed on basket conveyor 15 to be returned to the basket's original starting position to be again loaded with articles and the process repeated.

Figure 2:
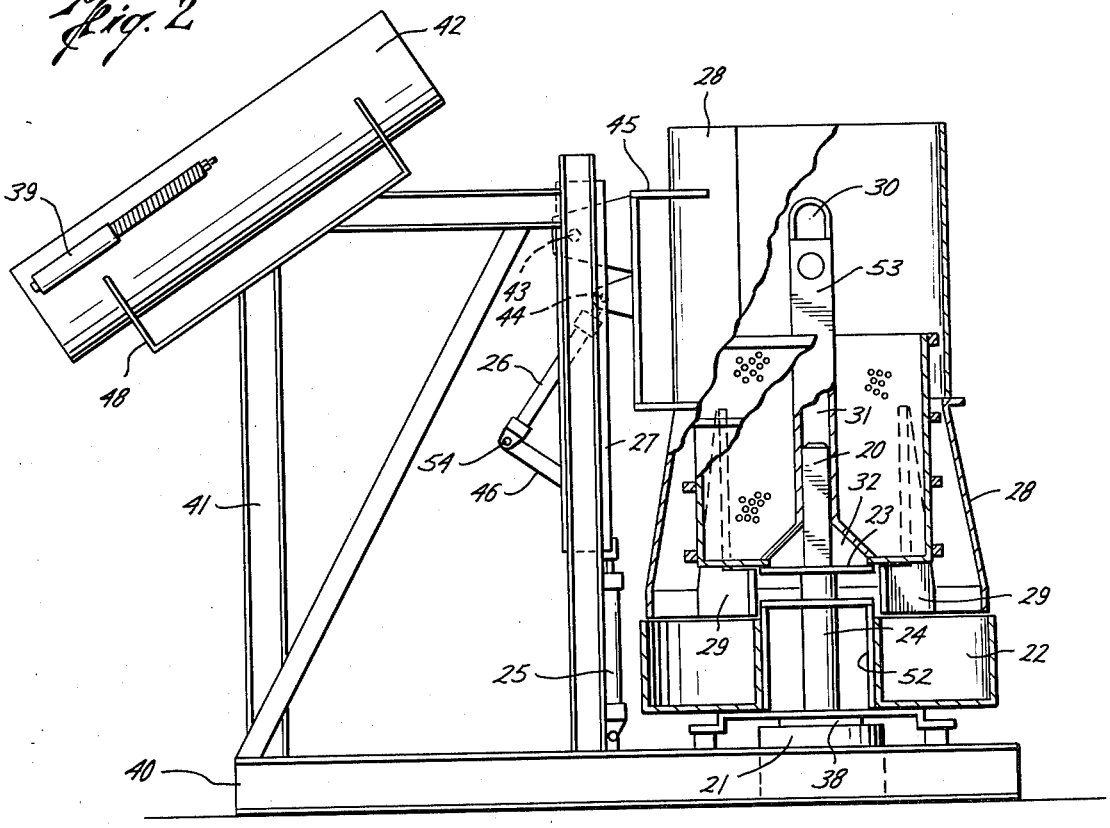
FIG. 2 is a pictorial elevation in partial cut-away showing a spin basket engagement with the spin mechanism and shield of the present invention.

Referring now to FIG. 2, there may be seen a pictorial representation in partial cut-away of centrifuge assembly 13, having deposed therein basket 10. Centrifuge assembly 13 rests upon a suitably sized platform 40 having support frame 41 attached thereto. Passing through and resting in platform 40 is hydraulic motor 21 in hydraulic communication with power unit 16 (not shown). Mechanically attached to hydraulic motor 21 is shaft 24 passing through motor cover 52. In this manner, shaft 24 puts hydraulic motor 21 in communication with turntable 23.

Turntable 23 freely rotates along the axis of shaft 24 and is capable of supporting weight which is transmitted down shaft 24 to be isolated from motor 21 by thrust bearing 38. It may be seen that turntable 23 may rotatably support basket 10 and the articles to be spun. A spindle 20 is mounted in the center of turntable 23 and spins, with the turntable, along the rotational axis of shaft 24. In the present embodiment, spindle 20 has a square cross section; however, it may be seen that spindle 20 may have any non-circular cross section such as oval, rectangular, hexagonal, etc.

Figure 3:
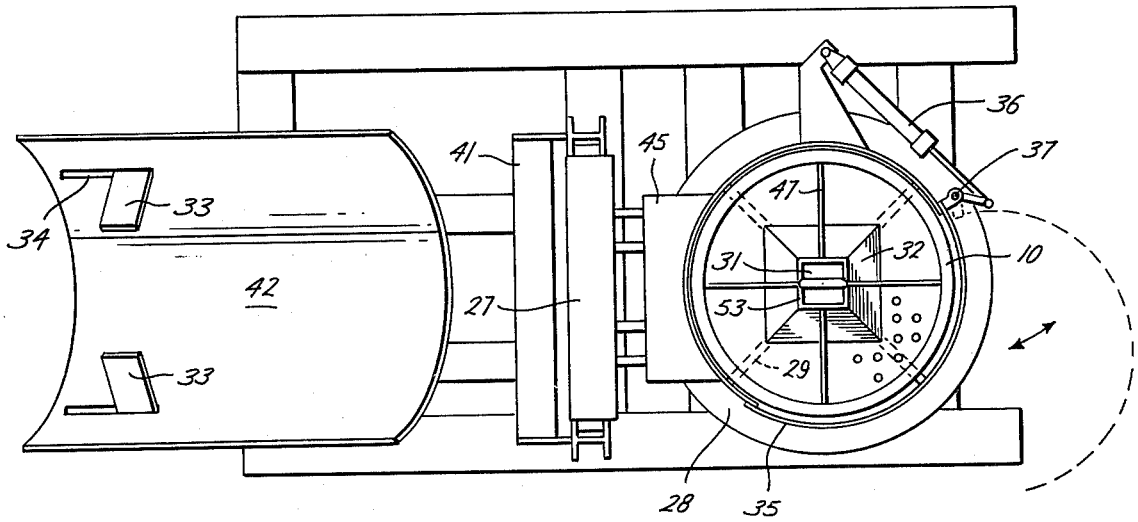
FIG. 3 is a top view of an embodiment of the present invention showing a spin basket and dumping chute of the present invention.

Basket 10 contains center post 53 having an interior sleeve 31 formed to engage spindle 20 and having eye 30 for hook engagement with a hoist. Referring now to FIGS. 2 and 3, it may be seen that center post 53 is supported within the interior of the basket by basket dividers 47 which act as internal supports to maintain the structural integrity of the basket during operations. Basket dividers 47 may also serve to separate the basket into portions which may contain differing articles. Of course, it will be readily seen that differing articles placed in each of the compartments defined by basket dividers 47 should be similar in weight distribution to facilitate spinning. In addition, spindle guide 32 may be formed in the lower portion of basket 10 to assist spindle 20 into engagement with spindle receiving sleeve 31. It may be seen in the illustrated embodiment that the complete weight of basket 10 rests upon the outer perimeter of turntable 23.

A shield 28 is provided to block the path of expelled molten metal or "spelter" and further to provide containment in the event of disintegration of the basket due to unforeseen circumstances such as an unbalanced load. Door 35 in the upper portion of shield 28 may be hydraulically actuated by door cylinder 36 to cause the door to pivot about door hinge 37. This automatic door opening may be used to facilitate the rapid introduction of basket 10 into the shielded area.

In operation, basket 10 may be removed from kettle 12 by any convenient means, such as a hoist, and brought to centrifuge assembly 13. Door 35 is automatically opened by door cylinder 36 to permit rapid introduction of the basket 10 into the area formed by shield 28. Basket 10 is lowered to permit spindle 20 to slide into engagement with sleeve 31 with the assistance of spindle guide 32, as required. The basket continues to be lowered until its weight rests upon turntable 23, and, in turn, down shaft 34 to be supported by thrust bearing 38, once basket 10 is in position, door 35 is automatically closed.

Motor 21 is actuated to rotate shaft 24, turntable 23, and spindle 20. As may clearly be seen, when shaft 20 is in engagement with sleeve 31, no rotational torque is lost through slippage due to the geometrical configuration of spindle 20 in relation to the sleeve 31. Therefore, rotational force is positively coupled to basket 10 from motor 21 without the utilization of any frictional component subject to slippage.

Basket 10 is rotationally accelerated sufficient to remove any excess molten metal clinging to the articles within the basket and to pass the excess molten metal through the basket perforates to be stopped by the interior of shield 28. The metal or spelter bounces off the interior of shield 28 to fall into spelter receiver 22 to be collected and reused. In a preferred embodiment of the present invention, the torque imparted to a basket has been sufficient to accelerate the basket from a rest to approximately 500 rpm within less than one second. Under acceleration of that magnitude, almost 20% more zinc is removed from the articles than the 2–5 second acceleration times typical in the prior art.

After the basket has been brought to the desired maximum rotational speed, conventionally 500–800 rpm, the direction of hydraulic motor 31 is reversed and the motor acts as a breaking mechanism to decelerate the basket 10 from a 500 rpm rotation to rest in slightly under 1 second. This rapid deceleration of basket 10 due to its positive coupling with the hydraulic motor 21 places inertial shock on the articles within the basket to break the articles from each other into separate discreet pieces. Once the articles are separated, they are amenable to automated handling. The 3–8 second deceleration time found in suspended and floor mounted centrifuges, respectively, is not sufficient for this purpose. Further, given the safety considerations of the suspended centrifuge technique and the friction coupling of the basket within the conventional floor mounted centrifuge, such deceleration times cannot be accomplished even with the addition of larger motors or superior frictional breaking mechanisms.

Referring jointly to FIGS. 2 and 3, there may be seen basket support legs 29 attached to the inner surface of shield 28. These support legs 29 are mounted to be beneath basket 10 when the basket rests upon turntable 23; however, there is no contact between the bottom of basket 10 and support legs 29 during the spinning cycle.

Shield 28 is attached to shield support frame 27 by means of shield support bracket 45. This bracket 45 is pivotally mounted about shield pivot 43 on the shield support frame 27. Shield support frame 27 is slidably mounted on frame 41. Cylinder support 46 is fixably mounted to the slidable shield support frame 27 to provide a connection for shield dump cylinder 26 which is mounted between cylinder support 46 and bracket 45 at pivot points 54 and 43, respectively.

In operation, it may be seen that after the spin cycle is completed and basket 10 is at rest upon turntable 23 within the shield 28, an automatic dumping cycle may be actuated. Lifting cylinder 25 is hydraulically actuated and shield support frame 27 is vertically lifted in slidable fashion along frame 41. Because bracket 45 is mounted on support frame 27, shield 28 is vertically lifted. Support legs 29 are fixedly attached to the interior of shield 28, therefore when shield 28 is raised vertically, the support legs 29 come into contact with the bottom surface of basket 10 and vertically lift basket 10 to separate and disengage the receiving sleeve 31 from spindle 20. After shield 28 and basket 10 have been sufficiently lifted to clear spindle 20, dump cylinder 26 is hydraulically actuated to cause the shield 28 and basket 10 to pivot approximately 120° about the shield pivot 43.

Figure 4:
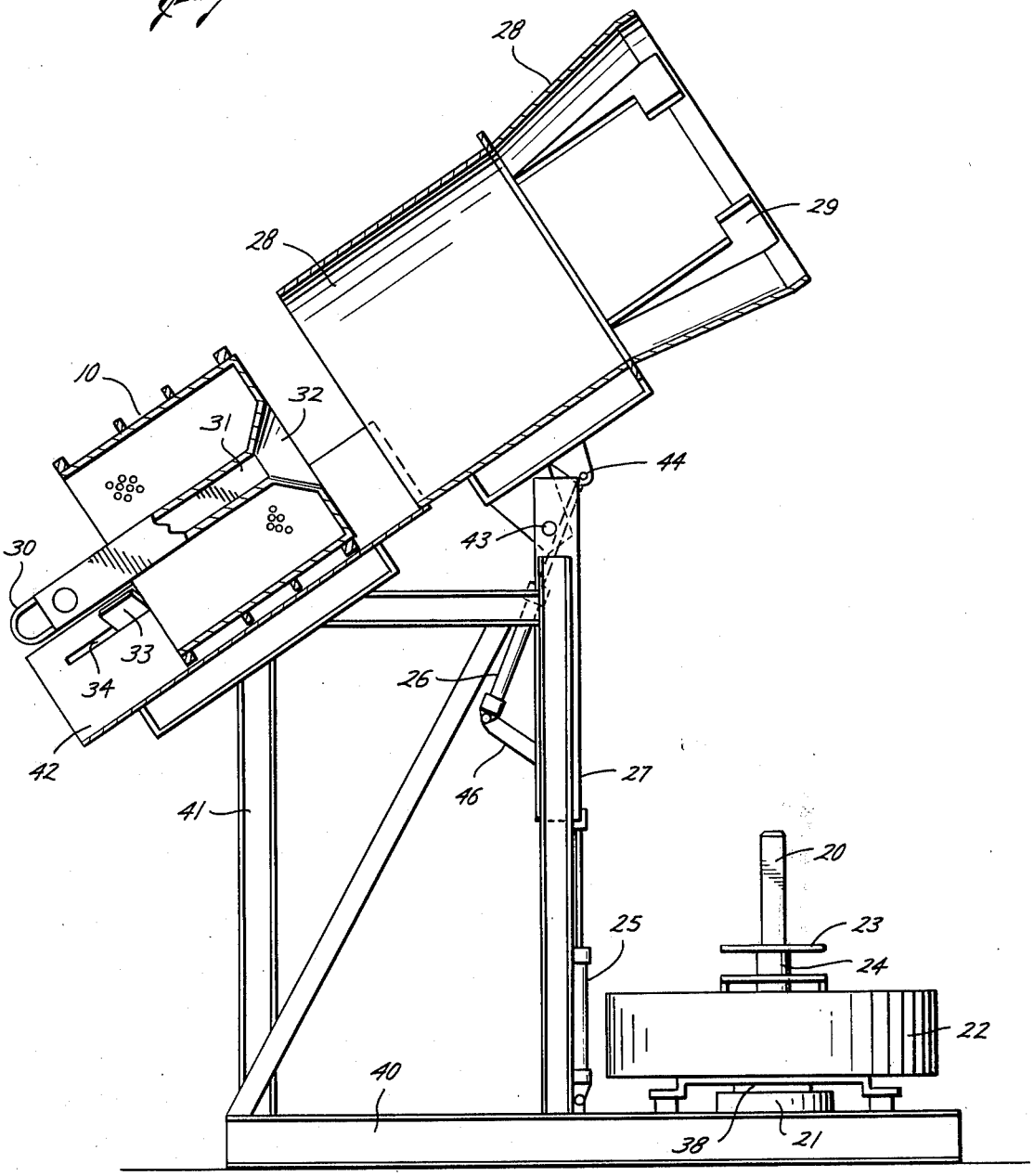
FIG. 4 is a side elevation of an embodiment of the present invention after the shield has been raised and placed in the chute to disgorge the spin basket.

Referring now to FIGS. 2, 3, and 4, there may be seen chute 42 mounted upon frame 41 which is adapted to receive basket 10 from shield 28 when shield 28 is in the full rotation position, as illustrated in FIG. 4. Shield 28 is aligned with chute 42 at an incline of approximately 60° to normal, although the exact slope of chute 42 may be adjusted to accommodate changing parameters, such as the length of the chute and the weight and desired terminal speed of the basket and its contents. At the downward end of chute 42 are basket stops 33 deposed in slots 34. Basket stops 33 are anchored to the outside of chute 42 through a spring and shock absorber assembly 39.

Clearly it may be seen that after shield 28 has been rotated about pivot 43, the lip of shield 28 overlaps the edge of chute 42 to provide a continuous downwardly inclined pathway. At full rotation of shield 28, basket 10, which heretofore has been resting upon basket support legs 29, is dumped from shield 28 down the incline to be received by chute 42.

The basket continues to slide down chute 42 until it comes into contact with basket stops 33 in slots 34. The concussion of basket 10 against basket stops 33 is sufficient to rapidly stop the downward motion of basket 10 and dislodge and expel the contents of basket 10 from the lower end of chute 42. Further, the concussion between basket 10 and stops 33 ensure that any remaining articles within basket 10 which have not been separated from each other by the rapid deceleration in the spinning cycle, are removed with such violence to separate into discrete pieces. Shock absorbers 39 may be predetermined or adjusted to ensure the proper concussive force of basket 10 against stops 33 to ensure expulsion of the contents of the basket 10 without undue violence. The articles removed from chute 42 may be disgorged into quench tank 14 as illustrated in FIG. 1.

Referring now to FIG. 5, there may be seen an end view of another embodiment of the present invention. In this embodiment, chute 42 is resting upon chute support bracket 48 which is pivotally attached to frame 41 by hinge 49. After the contents of basket 10 have been expelled, chute dump cylinder 50, which is pivotally attached to frame 41 at pivot points 51 and 55, respectively, is hydraulically actuated to exert a downward force on an edge chute 42 to cause chute 42 to pivot about chute hinge 49. This pivoting action, in turn, causes basket 10 to be ejected to the side of the centrifuge assembly 13. The basket now may be removed as desired, such as by conveyor assembly 15 of FIG. 1.

It is therefore apparent that the present invention is one well adapted to obtain all of the advantages and features hereinabove set forth, together with other advantages which will become obvious and inherent from a description of the apparatus itself. It will be understood that certain combinations and subcombinations are of utility and may be employed without reference to other features and subcombinations. This is contemplated by and is within the scope of the present invention.

What is claimed is:

1. An apparatus for removing excess molten metal from a group of articles, comprising:

a perforate container capable of confining articles coated with molten metal, a support means capable of supporting said perforate container, said support means being spinnably mounted on a substantially non-rotatable base, a coupling means releasably connecting said support means and said perforate container to positively, non-frictionally couple said perforate container to said support means, and a power means interconnected with said support means for accelerating said container to substantially at least 500 rpm in less than substantially 2 seconds and for thereafter decelerating said container to substantially zero rpm in less than substantially 3 seconds.

2. The apparatus of claim 1, wherein said coupling means includes an elongate member having a non-circular cross-section mounted on said support means and a sleeve within said perforate container, said elogate member adapted to engage said sleeve.

3. The apparatus of claim 2, further including shield means about said perforate container, and a lifting means to raise said shield means and said perforate container from said support means and thereafter place said perforate container on an inclined surface, an opening of said perforate container downwardly oriented on said inclined surface.

4. The apparatus of claim 3, wherein said inclined surface includes a stop means adapted to abruptly halt the downward movement of said perforate container with sufficient percussive force to dislodge said articles from said perforate container.

5. The apparatus of claim 4, wherein said inclined surface includes an ejection means for removing said perforated container from said inclined surface.

6. The apparatus of claim 1, including a removable shield means surrounding said support means to block molten metal thrown from said articles in response to rotational acceleration of said perforate container.

7. The apparatus of claim 6, wherein said shield means includes a flange means fixably attached to said shield means capable of disengaging said coupling means to separate said perforate container from said support means.

8. An apparatus for removing excess molten metal from a group of articles, comprising:

a perforate container capable of confining articles coated with molten metal, a support means capable of supporting said perforate container, said support means being spinnably mounted on a substantially non-rotatable base, a coupling means releasably connecting said support means and said perforate container to positively, non-frictionally couple said perforate container to said support means, and a power means interconnected with said support means to selectively impart rotational acceleration or deceleration to said support means, wherein said power means is a hydraulic motor connected to said support means capable of rotationally accelerating said support means, container and articles from substantially zero to greater than 500 rpm in less than approximately one second.

9. The apparatus of claim 8, wherein said power means is a hydraulic motor capable of rotationally decelerating said support means, said container and said articles from greater than 500 rpm to substantially zero rpm in less than approximately one second.

10. A method for removing excess molten metal from a group of articles, comprising:

retaining a group of articles coated with excess molten metal in a zone defined by a barrier which is permeable to molten metal, imparting a rapid angular acceleration to said group of articles sufficient to forceably remove said excess molten metal from the surface of said articles and pass said molten metal through said barrier, imparting a rapid angular deceleration to said group of articles sufficient to separate said group of articles into discrete articles, and thereafter gravitationally removing said discrete articles by inverting said discrete articles, accelerating said barrier and said articles, and abruptly halting said barrier with sufficient force to separate said discrete articles from said barrier.

11. A method for removing adhering molten metal from metallic articles, comprising:

accelerating said articles from zero rpm to substantially at least 500 rpm during a first time interval not greater than substantially 1 second, and, thereafter decelerating said articles to substantially zero rpm during a second time interval not greater than substantially one second.

12. A method for removing adhering molten metal from metallic articles, comprising:

applying a sufficiently high torque to accelerate said articles to substantially at least 500 rpm in less than substantially 2 seconds and to discharge substantially all excess molten metal from said articles, and thereafter oppositely applying substantially the same torque to decelerate said articles to zero rpm in less than substantially 3 seconds and to separate each of said articles one from the other.

* * * * *